United States Patent [19]

Roschinski

[11] Patent Number: 4,726,327

[45] Date of Patent: Feb. 23, 1988

[54] AIR GUIDE PANEL FOR AIR-COOLED INTERNAL COMBUSTION ENGINES

[75] Inventor: Dieter Roschinski, Cologne, Fed. Rep. of Germany

[73] Assignee: Kloeckner-Humboldt-Deutz AG, Fed. Rep. of Germany

[21] Appl. No.: 930,141

[22] Filed: Nov. 12, 1986

[30] Foreign Application Priority Data

Nov. 15, 1985 [DE] Fed. Rep. of Germany ..... 3540487

[51] Int. Cl.[4] ..... F02F 1/04

[52] U.S. Cl. ..... 123/41.69; 123/41.6

[58] Field of Search ..... 123/41.58, 41.6, 41.69, 123/41.7

[56] References Cited

U.S. PATENT DOCUMENTS 1,671,634 5/1928 Forbes ..... 123/41.6

4,633,823 1/1987 Haas et al. ..... 123/41.69

*Primary Examiner*—Stephen F. Husar

*Attorney, Agent, or Firm*—Charles L. Schwab

[57] ABSTRACT

An air guide panel is provided for an air-cooled internal combustion engine which has closable cleaning openings between the cooling air openings. This air guide panel makes it easier to clean the cooling fins on the cylinder pipes because the cleaning process can be carried out without removing the air guide panel.

13 Claims, 6 Drawing Figures

AIR GUIDE PANEL FOR AIR-COOLED INTERNAL COMBUSTION ENGINES

TECHNICAL FIELD

This invention relates to an air guide panel for air-cooled internal combustion engines and more particularly to an air guide panel having a cleaning feature.

PRIOR ART STATEMENT

Air guide panels are installed on air-cooled engines in order to guarantee an optimal distribution of cooling air around the cylinder pipe. Since the cooling fins arranged along the cylinder pipe become dirty with time, they must be cleaned. In air-cooled engines manufactured by Kloeckner-Humboldt-Deutz AG, the assignee of this application for patent, an air guide panel is releasably secured to one lateral side of the engine cylinder pipes by means of high-speed fasteners. Cooling air outlet openings, which are located opposite the middle of the cylinder, are arranged in the air guide panel through which the cooling air can disperse. In order to clean the cylinder cooling fins, the air guide panel can be removed after removing the high-speed fasteners.

The disadvantage of this air guide panel lies in the fact that it must be removed from the engine during the cleaning process. During this time consuming process, the air guide panel can be unintentionally bent or lost, or it may inadvertently be left off after cleaning.

OBJECTS AND BRIEF SUMMARY OF THE INVENTION

A main object of this invention is to provide an air guide panel for an air-cooled engine whose cooling fins can be cleaned without removing the air guide panel from the engine.

The air guide panel of this invention is arranged at one lateral side of two adjacent cylinders of an air-cooled internal combustion engine. The air guide panel has cooling air outlet openings and closable cleaning openings between the cooling air openings. A panel so constructed permits the cooling fins of the cylinders to be cleaned, through the cleaning openings, without removing the panel from the engine.

Preferably, the air guide panel includes a stationary component secured to the engine and a movable component which can be shifted along the stationary component between an engine operating position, in which the cleaning openings are closed and the cooling air openings are open, and a cleaning position in which the cleaning openings are open. Only the movable component need be shifted along the stationary component during cleaning of the cooling fins of the cylinders and additional space around the assembled air guide panel is not required for the cleaning process. Thus, the air guide panel arrangement is very space efficient, and the maintenance personnel have easy, quick access to the cooling fins.

In one embodiment of the invention, slots are provided in the movable component and guide pins are mounted on the stationary component which extend into the slots thus making it possible to shift the movable component along the stationary component. In such a construction, it is preferred that at least one of the guide pins be designed as a locking bolt, and that the movable component be biased against the stationary component.

It is also desirable to provide laterally inwardly extending plates on the stationary component of the air guide panel to guide the cooling air.

In a second embodiment of the invention, a spring is provided between the stationary and movable components which resiliently biases the movable component to its engine operating position in which the cleaning openings are closed and the cooling air openings are open. In this second embodiment, the movable component may be guided in guide tracks on the stationary component.

BRIEF DESCRIPTION OF THE DRAWINGS

Structural features of the invention are illustrated in the drawings, in which.

DETAILED DESCRIPTION OF THE DRAWINGS

Figure 1:
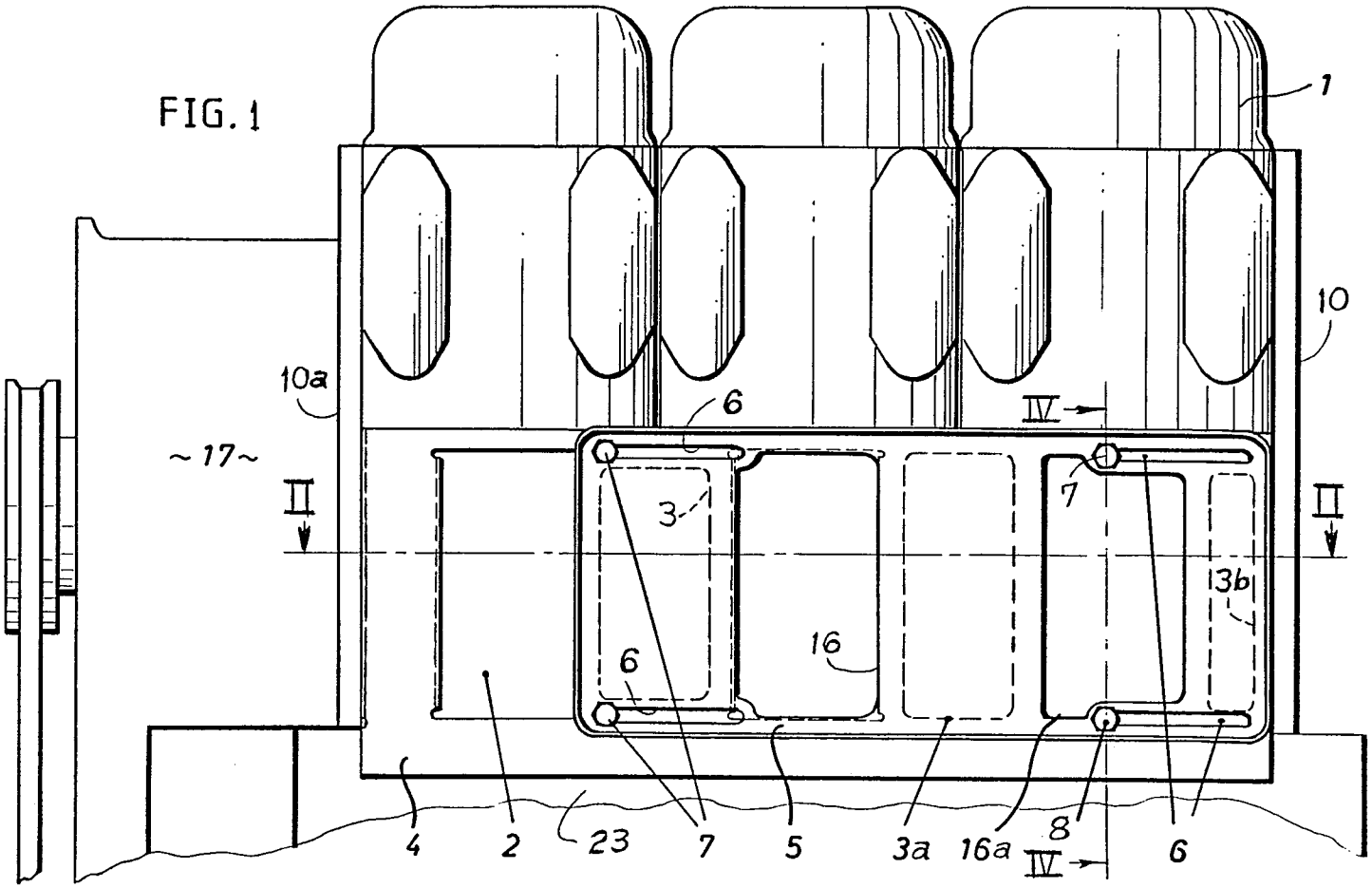
FIG. 1 is a partial side view of an air-cooled engine incorporating one version of the air guide panel.
Figures 2, 3:
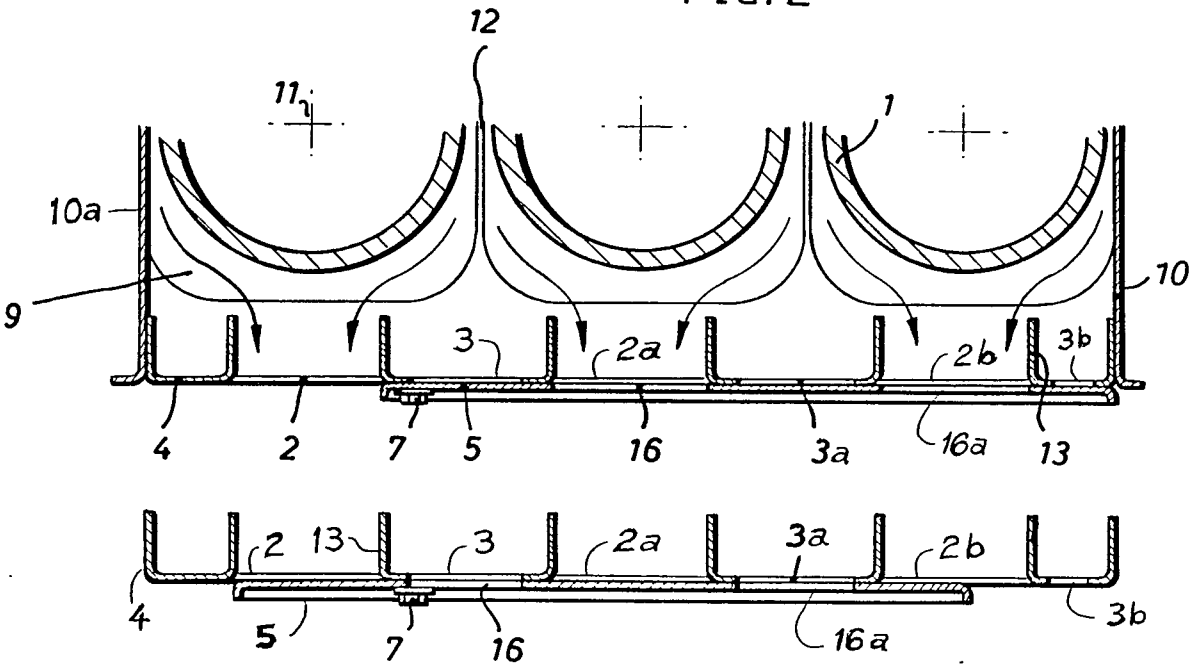
FIG. 2 is a partial section taken on the line II—II in FIG. 1.
FIG. 3 is a view similar to FIG. 2 but showing the air guide panel adjusted to a cleaning position.
Figure 4:
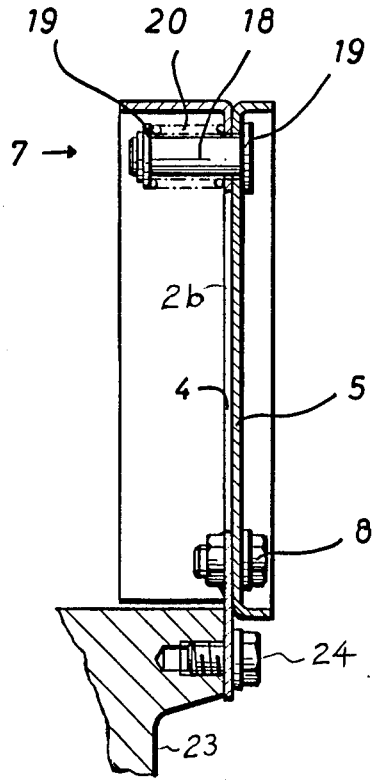
FIG. 4 is a view taken along the line IV—IV in FIG. 1.

Referring to FIGS. 1, 2, 3 and 4, an air guide panel of this invention includes a stationary component 4, secured to the engine casing 23 by fasteners, such as the cap screw 24 shown in FIG. 4, and a movable component 5 which is selectively shiftable between its normal engine operating position shown in FIGS. 1 and 2 to its cleaning position shown in FIG. 3. The stationary component 4 is positioned between air duct walls 10, 10*a* in confronting relation to corresponding lateral sides of three cylinders 1. The stationary component 4 is a rectangular plate which has alternating cooling air openings 2, 2*a*, 2*b* and cleaning openings 3, 3*a*, 3*b*, whereby the cooling air openings are opposite the cylinder axes, one of which is designated with the number 11, and the cleaning openings are opposite the junctures of the cylinders, one of such juncture points being indicated by the number 12. In order to provide better cooling air guidance, vertical plates 13 are formed on the stationary component 4 at longitudinally opposite edges of the cooling air openings 2, 2*a*, 2*b*. The guide plates 13 extend laterally inward toward the fins 9 on the cylinders 1 and are perpendicular to the stationary component 4. In order to provide sliding support for the movable component 5 on the stationary component 4, guide pins 7 and 8 are mounted on the stationary component 4 and extend through longitudinally extending slots 6 in the movable component 5, thus making it possible to selectively shift the movable component 5 longitudinally on the stationary component. In the engine operating position shown in FIGS. 1 and 2, the cleaning openings 3, 3*a*, 3*b* are overlapped by vertical wall portions of the movable component 5 to thereby close the cleaning openings 3, 3*a*, 3*b*, while the cooling air openings 2*a*, 2*b* in the stationary component 4 register, respectively, with the openings 16, 16*a* in the movable component 5 and are thereby in an open or engine cooling condition. In the cleaning position of the movable component 5, shown in FIG. 3, it has been shifted longitudinally along the stationary component 4 to such an extent that the openings 16, 16*a* in the movable component 5 are brought into alignment (registration) with the cleaning openings 3, 3*a* in the stationary component 4. Thus the cleaning openings 3, 3*a*, 3*b* are closed in the engine operating position of the movable component 5 and are opened in the cleaning position of the movable component.

As shown in FIG. 4, the guide pin 8 is a locking bolt which extends through a slot 6 in the movable component and through a bore in the stationary component. The threaded end of the bolt 8 is in threaded engagement with a nut secured by welding to the inner side of the stationary component 4.

The spring pressured guide pin 7 includes a pin part 18 which extends through a slot 6 in the movable component 5 and through a bore in the stationary component 4, and presents heads 19, 19′ at its opposite ends. Between the heads 19, 19′, a helical compression spring 20 is positioned on the pin part 18 which urges the movable component 5 into frictional engagement with the stationary component 4.

As shown in FIGS. 1 and 2, a cooling air blower 17 is mounted at the front of the internal combustion engine and cooling air delivered by the blower passes between the cylinders 1 and across the cooling fins 9 thereof and then exits by way of the cooling air openings 2, 2*a*, 2*b* in the air guide panel. The movable component 5 of the air guide panel is in its operating position in which openings 16 and 16*a* register with openings 2*a* and 2*b* whereby all the openings 2, 2*a* and 2*b* are open, while the cleaning openings 3, 3*a*, 3*b* are closed by confronting vertical wall portions of the movable component. If the movable component 5 is shifted forward in the direction of cooling air blower 17 along the stationary component 4, the openings 16 and 16*a* in the movable component are shifted so that they register with the cleaning openings 3 and 3*a* in the stationary component 4. The releasable locking bolt 8 permits the movable component 5 to be selectively secured in either of its operating and cleaning positions. The movable component 5 is preferably supported on the stationary component by the spring pressure guide pins 7 and a locking bolt 8 so as to avoid a loose connection.

Figure 6:
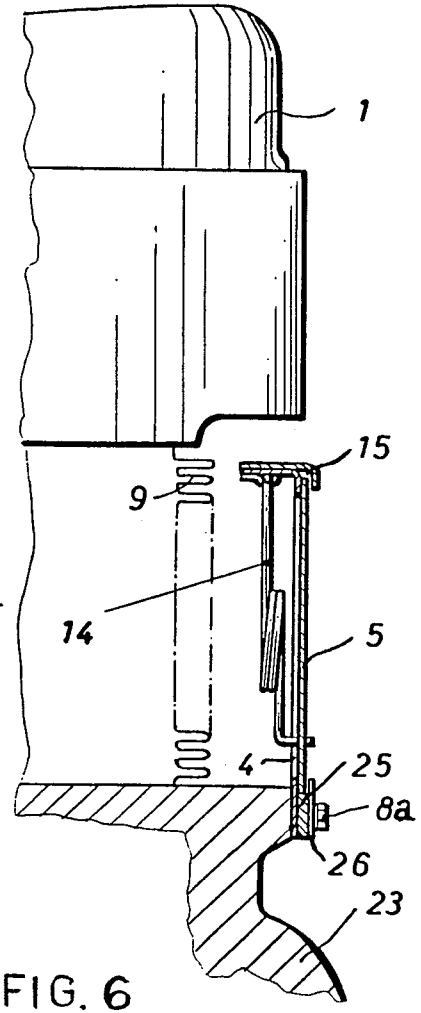
FIG. 6 is a view taken along the line VI—VI in FIG. 5.
Figure 5:
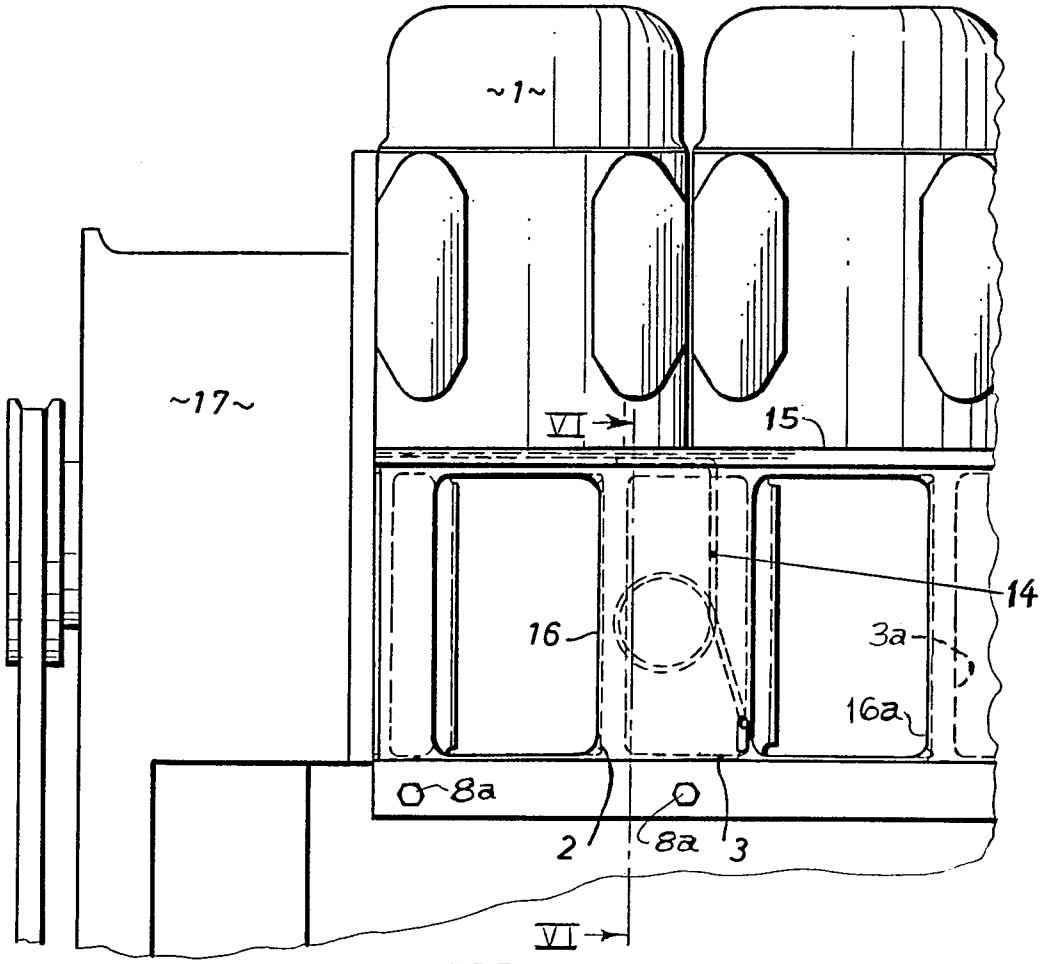
FIG. 5 is a partial side view of an air-cooled engine incorporating a second embodiment of the air guide panel of this invention.

Referring to FIGS. 5 and 6, a second embodiment of this invention is shown in which a spiral or coil spring 14 has been inserted between the stationary component 4 and the movable component 5. The stationary component 4 of the air guide panel is secured at its lower end to the engine casing 23 by cap screws 8*a*. The upper end of the movable component 5 is slidingly supported in a guide groove or channel formed by an angle 15 of an L-shaped section secured to the stationary component 4. A downwardly extending flange of the L-shaped guide angle 15 is spaced laterally outward of the stationary component 4 to which it is secured so as to form an inverted U-shaped guide for the upper edge of the movable component 5. The air guide panel also includes a guide groove or channel for the lower edge of the movable component 5 which is formed by a guide strip 26 held in laterally outward spaced relation to the stationary component 4 by spacers 25 and the cap screws 8*a*, which extend through aligned openings in the strip 26, spacers 25 and stationary component 4 and are in threaded engagement with drilled and tapped openings, not shown, in the engine casing 23. The spiral spring 14 has one of its legs securely fastened to the stationary component 4 and its other leg connected to the movable component 5 whereby the spring 14 resiliently urges the movable component 5 toward its operating position (as shown in FIG. 5) in which the cleaning openings 3, 3*a* are closed.

The embodiments of the invention in which an exclusive property or privilege is claimed are defined as follows:

1. An air guide panel for an air-cooled internal combustion engine which is arranged along a lateral side of at least two adjacent cylinders and has cooling air outlet openings characterized by closable cleaning openings in the air guide panel between the cooling air openings.

2. The air guide panel of claim 1 wherein said air guide panel includes a stationary component which is secured to the engine and a movable component shiftable along said stationary component between engine operating and cleaning positions, said cleaning openings being closed in said engine operating position of said movable component and being open in said cleaning position of said movable component.

3. The air guide panel of claim 2 wherein said air guide panel includes guide pins mounted on said stationary component and slots in the movable component, said guide pins extending into said slots to guide said movable component along said stationary component between said engine operating and cleaning positions.

4. The air guide panel of claim 3 wherein at least one of the guide pins is a locking bolt.

5. The air guide panel of claim 3 and further comprising biasing means urging said components into frictional engagement with one another.

6. The air guide panel of claim 5 wherein said biasing means includes a resilient coil spring surrounding each of a plurality of said guide pins.

7. The air guide panel of claim 6 wherein at least one of said guide pins is a locking bolt and the remaining of said guide pins are each surrounded by a coil spring.

8. The air guide panel of claim 2 wherein said movable component is supported by means including a resilient biasing spring urging said movable component toward its engine operating position.

9. The air guide panel of claim 8 wherein said spring is a spiral spring having a pair of legs connected, respectively, to said components.

10. The air guide panel of claim 2 wherein said stationary component includes plates extending toward said cylinders to guide the cooling air.

11. The air guide panel of claim 2 wherein said movable component has at least one opening which registers with one of said cooling air openings in said engine operating position and with said one of said cleaning openings in said cleaning position.

12. The air guide panel of claim 2 wherein upper and lower guides are provided on said stationary component and the upper and lower edges of said movable component engage said guides, respectively, thereby serving to guide said movable component in its shifting movement between its engine operating and cleaning positions.

13. The air guide panel of claim 12 and further comprising spring means operatively interposed between said components and resiliently urging said movable component toward its engine operating position.

* * * * *